US005618657A

United States Patent [19]

Rieger et al.

[11] Patent Number: 5,618,657

[45] Date of Patent: Apr. 8, 1997

[54] PHOTOGRAPHIC SILVER HALIDE ELEMENT HAVING POLYESTER SUPPORT AND EXHIBITING IMPROVED WET ADHESION

[75] Inventors: John B. Rieger; Paul L. Zengerle, both of Rochester; John W. Boettcher, Webster, all of N.Y.

[73] Assignee: Eastman Kodak Company, Rochester, N.Y.

[21] Appl. No.: 390,846

[22] Filed: Feb. 17, 1995

[51] Int. Cl.[6] ..... G03C 5/26; G03C 1/04; G03C 1/38

[52] U.S. Cl. ..... 430/434; 430/510; 430/531; 430/634; 430/638

[58] Field of Search ..... 430/510, 531, 430/546, 934, 935, 638, 517, 434, 467, 634

[56] References Cited

U.S. PATENT DOCUMENTS

| | | | |
|---|---|---|---|
| 3,649,336 | 3/1972 | Van Paesschen et al. | 428/451 |
| 4,116,696 | 9/1978 | Tatsuta et al. | 430/531 |
| 4,547,459 | 10/1985 | Kamio et al. | 430/631 |
| 5,292,628 | 3/1994 | Nittel et al. | 430/539 |
| 5,342,746 | 8/1994 | Zengerle et al. | 430/546 |
| 5,360,702 | 11/1994 | Zengerle et al. | 430/505 |
| 5,372,922 | 12/1994 | Schofield et al. | 430/572 |

FOREIGN PATENT DOCUMENTS

| | | |
|---|---|---|
| 035614 | 9/1981 | European Pat. Off. . |

OTHER PUBLICATIONS

Keller, K., Science and Technology of Photography, pp. 68–69 and 203–206, VCH Publishers, 1993.

*Primary Examiner*—Janet C. Baxter
*Attorney, Agent, or Firm*—Arthur E. Kluegel

[57] ABSTRACT

A photographic element comprises a polyester support bearing a light-sensitive silver halide photographic emulsion layer, the support having adjacent thereto a polymer-containing subbing layer, the subbing layer having adjacent thereto a layer comprising a hydrophilic binder containing dispersed droplets of a high boiling organic liquid, the liquid being selected form the group consisting of oleyl alcohol and esters of organic or inorganic acids which have a value for the logarithm of their octanol/water partition coefficient (Log P) of from 2.6 to 6.7.

30 Claims, No Drawings

PHOTOGRAPHIC SILVER HALIDE ELEMENT HAVING POLYESTER SUPPORT AND EXHIBITING IMPROVED WET ADHESION

FIELD OF THE INVENTION

This invention relates to silver halide photographic materials, and more specifically to multilayer photographic materials comprising a polyester support having coated thereon a layer containing a hydrophilic binder with dispersed droplets of a selected high-boiling organic liquid.

BACKGROUND OF THE INVENTION

It is well known to coat silver halide photographic materials on cellulose acetate supports. In certain instances, it has been found advantageous to coat these materials on polyester supports when increased dimensional stability or mechanical strength of the photographic element is desired, as described in U.S. Pat. No. 3,649,336. In particular, it has been found that a polyethylene naphthalate ("PEN") support has excellent mechanical strength and curl relaxation characteristics compared to other supports. However, it is more difficult to obtain the required adhesion characteristics when coating aqueous-based photographic compositions on these polyester films, in contrast to the conventionally employed cellulose acetate based support, as noted in U.S. Pat. Nos. 5,292,628 and 4,116,696 and European Patent Publication EP 035,614.

It is well-known to apply to a support one or more subbing layers followed by the direct coating of a photographic layer in order to improve the adhesion of a subsequent layer.

It is also well-known to improve the adhesive strength between a layer adjacent to a support and the surface of the support by way of a surface treatment. Examples of these surface activation treatments include, but are not limited to: a chemical treatment, a mechanical treatment, a corona discharge, a flame treatment, a UV irradiation, a radio-frequency treatment, a glow discharge, an active plasma treatment, a laser treatment, a mixed acid treatment or ozone-oxidation. Such treatment may be employed with or without the application of a subbing layer. With a polyester based support, even the additional application of a polymer subbing layer has failed to provide the desired degree of adhesion.

If the adhesion between the photographic layers and the support is insufficient, several practical problems arise. If the photographic material is brought into contact with a sticky material, such as splicing tape, the photographic layers may be peeled from the support resulting in a loss of image-forming capability. In the manufacturing process, the photographic material is subjected to slitting or cutting operations and in many cases perforated holes are punched into the material for film advancement in cameras and processors. Poor adhesion can result in a delamination of the photographic layers from the support at the cut edges of the photographic material which can generate many small fragments of chipped-off emulsion layers which then cause spot defects in the imaging areas of the photographic material.

The foregoing property may be referred to as "dry adhesion". This property may be distinguished from "wet adhesion" which refers to the tendency of a photographic element to delaminate during wet processing of exposed film. The element may undergo spot delamination or blistering due to processing at elevated temperatures or may be damaged by transport rollers during processing or subsequent thereto.

In U.S. Pat. No. 4,116,696, improved dry adhesive strength between a polyethylene terephthalate support and a photographic layer was obtained using a subbing layer containing a hydrophilic resin and droplets of a nonvolatile or low volatile hydrophobic liquid, which is not completely miscible with the subbing layer composition, having a boiling point above about 120° C. and a solubility in water of about 10 g/100 g water or less at 25° C. Thus, this improvement was obtained by altering the composition of the subbing layer which is coated directly on the polyester support, as opposed to the present invention, which involves the composition of the bottom-most photographic layer, coated above the subbing layer.

Furthermore, U.S. Pat. No. 4,116,696 discloses hydrophobic liquids having a solubility in water of about 10 g/100 g water or less. This encompasses a vast number of hydrophobic liquids which vary widely in terms of their chemical properties. There is no differentiation among solvents in this patent, and thus it is not apparent from this reference that different solvents can have vastly different effects on the adhesion to the support. In the present invention, we have found that only a limited number of high boiling organic solvents are effective at promoting wet adhesion of polyester supports and the use of these materials to improve "wet" as opposed to "dry" adhesion has not been suggested.

U.S. Pat. No. 5,292,628 teaches that improved wet adhesion of photographic layers to a polyester film base is provided with a layer containing an oil-in-water emulsion consisting of oil-formers, colloidal silicon dioxide, and gelatin. Again, the solution to the adhesion problem involves improved subbing layer technology, as opposed to formulation of the bottom-most photographic layer over a subbing layer as described in the present invention. The patentee notes that "both the high oil-former content and the presence of colloidal silicic acid is a condition for adhesion improvement." In addition, the high-boiling organic solvents employed cover a very wide range of materials including many solvents ineffective in accordance with the invention.

U.S. Pat. No. 4,495,273 describes a color photographic element coated on cellulose triacetate support with improved mechanical properties. Dry adhesion between the photographic layers and the support is increased using a combination of droplets of a water-immiscible high boiling organic solvent and an adhesion promoting quantity of a vinyl addition polymer latex in the antihalation layer of the photographic element. The acetate support is a wholly different class from polyester. Again, the solvents are taught without regard to the recognition that most of the solvents are not useful for improving wet adhesion. Further, the patentee also requires the presence of a vinyl addition polymer latex which is not essential in the present invention.

Methods of improving adhesion to polyester supports include altering the subbing layer, which is usually a very thin layer containing very low levels of gelatin, making it difficult to incorporate effective quantities of an adhesion promoting solvent. Also, substantial additions to this layer cause its thickness to be increased, which can result in the subbing layer being less effective at promoting adhesion of subsequently applied photographic emulsion layers. Increased thickness is also not desirable due to other system constraints such as providing a maximum number of exposures in a cartridge.

The problem to be solved is to provide a photographic element having a polyester support which has improved wet adhesion of the hydrophilic photographic layers to the polyester support so that the film layers will remain in tact during the wet processing of the film.

SUMMARY OF THE INVENTION

The invention provides a photographic element comprising a polyester support bearing a light-sensitive silver halide photographic emulsion layer, the support having adjacent thereto a polymer-containing subbing layer, the subbing layer having adjacent thereto a layer comprising a hydrophilic binder containing dispersed droplets of a high boiling organic liquid, said liquid being selected from the group consisting of oleyl alcohol and esters of organic or inorganic acids which have a value for the logarithm of their octanol/water partition coefficient (Log P) of from 2.6 to 6.7.

The invention also includes a process for preparing a photographic element of the invention and a process for forming an image in an element of the invention. The invention further includes a photographic element comprising a polyester support bearing a hydrophilic layer containing an antihalation agent, such as elemental silver, with or without an intervening subbing layer.

The invention provides a silver halide photographic light-sensitive material which exhibits good wet adhesion between the photographic emulsion layers and a polyester support.

DETAILED DESCRIPTION OF THE INVENTION

Supports which can be used in this invention include any supports of hydrophobic, high molecular weight polyesters. Suitable supports typically have a glass transition temperature ($T_g$) greater than 90° C. The support may be produced from any suitable synthetic linear polyester which may be obtained by condensing one or more dicarboxylic acids or their lower alkyl esters, e.g. terephthalic acid, isophthalic acid, phthalic acid, 2,5-, 2,6-, and 2,7-naphthalene dicarboxylic acid, succinic acid, sebacic acid, adipic acid, azelaic acid, diphenyl dicarboxylic acid, and hexahydroterephthalic acid or bis-p-carboxyl phenoxy ethane, optionally with a monocarboxylic acid, such as povalic acid, with one or more glycols, e.g., ethylene glycol, 1,3-propanediol, 1,4-butanediol, neopentyl glycol and 1,4-cyclohexanedimethanol. Suitable supports include, for example, polyesters such as polyethylene terephthalate, polyhexamethylene terephthalate, polyethylene-2,6-naphthalate, polyethylene-2,5-naphthalate, and polyethylene-2,7-naphthalate. Within the contemplation of the invention are supports based on copolymers and/or mixtures of polyesters based on different monomers.

Suitable supports are described in Research Disclosure, September 1994, Item 36544 available from Kenneth Mason Publications Ltd, Dudley House, 12 North Street, Emsworth Hampshire PO10 7DQ, England (hereinafter "Research Disclosure") and in Hatsumei Kyoukai Koukai Gihou No. 94-6023, Japan Invention Association, Mar. 15, 1994, available from the Japanese Patent Office. Supports with magnetic layers are described in Research Disclosure, November 1992, Item 34390.

The supports and associated layers may contain any known additive materials. They may be transparent or can contain a dye or a pigment such as titanium dioxide or carbon black.

If desired, the support may be subjected to a surface treatment to activate the surface on the emulsion layer side. Such treatments include, for example, a chemical treatment, a mechanical treatment, a corona discharge, a flame treatment, a UV irradiation, a radio frequency treatment, electron bombardment, a glow discharge, an active plasma treatment, electrodeless discharge, a laser treatment, a mixed acid treatment, or ozone-oxidation treatment. Specifics on such treatments may be found, for example, in Hatsumei Kyoukai Koukai Gihou No. 94-6023, previously cited.

In a suitable embodiment, the support may be initially treated with an adhesion promoting agent such as, for example, one containing at least one of resorcinol, orcinol, catechol, pyrogallol, 1-naphthol, 2,4-dinitrophenol, 2,4,6-trinitrophenol, 4-chlororesorcinol, 2,4-dihydroxy toluene, 1,3-naphthalenediol, 1,6-naphthalenediol, acrylic acid, sodium salt of 1-naphthol-4-sulfonic acid, benzyl alcohol, trichloroacetic acid, dichloroacetic acid, o-hydroxybenzotrifluoride, m-hydroxybenzotrifluoride, o-fluorophenol, m-fluorophenol, p-fluorophenol, chloral hydrate, and p-chloro-m-cresol.

The photographic element of the invention includes a polymer-containing subbing layer on the treated support. By the term "polymer-containing" subbing layer it is not meant to exclude the presence of other layer components. Examples of suitable polymers for this purpose are shown in U.S. Pat. Nos. 2,627,088; 2,968,241; 2,764,520; 2,864,755; 2,864,756; 2,972,534; 3,057,792; 3,071,466; 3,072,483; 3,143,421; 3,145,105; 3,145,242; 3,360,448; 3,376,208; 3,462,335; 3,475,193; 3,501,301; 3,944,699; 4,087,574; 4,098,952; 4,363,872; 4,394,442; 4,689,359; 4,857,396; British Patent Nos. 788,365; 804,005; 891,469; and European Patent No. 035,614. Often these include polymers of monomers having polar groups in the molecule such as carboxyl, carbonyl, hydroxy, sulfo, amino, amido, epoxy or acid anhydride groups, for example, acrylic acid, sodium acrylate, methacrylic acid, iraconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers.

Additional examples are polymers of ethylenically unsaturated esters or ethylenically unsaturated acids represented by, for example, acrylic acid esters such as ethyl acrylate or butyl acrylate, methacrylic acid esters such as methyl methacrylate or ethyl methacrylate, acrylic acid or methacrylic acid, or the acid derivatives thereof, or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers.

The above-described polymers can be used as an aqueous solution, a solution in an organic liquid or a dispersion as a latex in water. Suitably, the subbing layer contains from 25 to 85 wt. % polymer.

The layer applied over the subbing layer contains a hydrophilic binder and dispersed high-boiling organic liquid droplets. Suitably, the wt. ratio of hydrophilic binder to organic liquid in the hydrophilic binder layer is at least 3 to 1. Examples of suitable hydrophilic binders for the photographic layer (hydrophilic organic protective colloid), which can be used in this invention, include synthetic or natural hydrophilic high molecular weight gelatin-based compounds, for example, gelatin, acylated gelatin (phthalated gelatin or maleated gelatin), cellulose derivatives such as carboxymethyl cellulose or hydroxyethyl cellulose, grafted gelatin prepared by grafting acrylic acid, methacrylic acid or the amides thereof to gelatin the copolymers thereof or the partially hydrolyzed products thereof. Often these include polymers of monomers having polar groups in the molecule such as carboxyl, carbonyl, hydroxy, sulfo, amino, amido, epoxy or acid anhydride groups, for example, acrylic acid, sodium acrylate, methacrylic acid, iraconic acid, crotonic acid, sorbic acid, iraconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers These binders can be used individually or in admixture.

Additional examples are polymers of ethylenically unsaturated esters or ethylenically unsaturated acids represented by, for example, acrylic acid esters such as ethyl acrylate or butyl acrylate, methacrylic acid esters such as methyl methacrylate or ethyl methacrylate, acrylic acid or methacrylic acid, or the acid derivatives thereof, or copolymers of these monomers with other vinylic monomers; or copolymers of polycarboxylic acids such as iraconic acid, iraconic anhydride, maleic acid or maleic anhydride with vinylic monomers such as styrene, vinyl chloride, vinylidene chloride or butadiene, or trimers of these monomers with other ethylenically unsaturated monomers.

Of the above-described binders, gelatin including a gelatin derivative is most generally used, but gelatin can be partially replaced with a synthetic high molecular weight substance.

The suitable high boiling organic liquids of the invention have a boiling point of at least 120° C. and, suitably, at least 160° C. Useful organic liquids have been found to be appropriately selectable from oleyl alcohol and those esters having a logarithm of their octanol/water partition coefficient (Log P) of between 2.6 and 6.7, preferably between 4.2 and 6.7. Suitable examples include di-n-butyl phthalate, phenylethyl benzoate, acetyl-tri-butyl citrate, dibutyl sebacate, oleyl alcohol, trihexylphosphate, and tricresylphosphate.

In the present invention, other photographically useful materials may also be present in the layer adjacent to the subbed support. These include, for example, black colloidal silver, preformed dyes, ultraviolet absorbing compounds, oxidized developer scavengers, sequestering agents, etc. These materials may or may not be dispersed in a high-boiling organic liquid. The high-boiling organic liquid used to introduce these agents may or may not be the organic liquids specified in the present invention.

In the specific case in which other high-boiling organic liquids are employed in the layer adjacent to the subbed support, it is preferred that the wet adhesion promoting liquid be at least 25 wt % of the total organic liquid in the layer.

Unless otherwise specifically Stated, substituent groups usable on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy) acetamido, alpha-(2,4-di-t-pentylphenoxy) butyramido, alpha- (3 -pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application.

To control the migration of various components, it may be desirable to include a high molecular weight hydrophobe or "ballast" group in the component molecule. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, the contents of which are incorporated herein by reference.

*Research Disclosure,* June 1994, Item 36230 provides information on suitable film adaptions for small format film.

In the following discussion of suitable materials for use in the emulsions and elements of this invention, reference will be made to *Research Disclosure,* September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," publ ished in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mittei lungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Patent Nos. 1,939,231; 2,181,944; 2,333,106; and 4,126,461; German OLS No. 2,644,194 and German OLS No. 2,650,764. Typically, such couplers are resorcinols or maminophenols that form black or neutral products on reaction with oxidized color developing agent.

In addition to the foregoing, so-called "universal" or "washout" couplers may be employed. These couplers do not contribute to image dyeformation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl) amino)-, dodecyl ester and a slow yellow layer containing the same compound together with "Coupler 2": Propanoic acid, 2-[[5-[[4-[2-[[[2,4-bis(1,1-dimethylpropyl) phenoxy]acetyl]amino]-5-[(2,2,3,3,4,4,4-heptafluoro-1-oxobutyl) amino]-4hydroxyphenoxy]-2,3-dihydroxy-6-[(propylamino) carbonyl phenyl] thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl)-1H-benzotriazol-1-yl) propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl) phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl) phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6(((3-(dodecyloxy) propyl) amino)carbonyl)-5-hydroxy-1-naphthalenyl)-, 2-methylpropyl ester, "Coupler 7": Acetic acid, ((2-((3-(((3-(dodecyloxy)propyl)amino) carbonyl)-4-hydroxy-8-(((2-methylpropoxy)carbonyl) amino)-1-naphthalenyl)oxy)ethyl)thio)-, and "Coupler 8"Benzamide, 3-((2- (2,4-bis (1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10"Tetradecanamide, N-(4-chloro-3-((4-((4-((2,2-dimethyl-1-oxopropyl) amino)phenyl)azo)-4,5-dihydro-5-oxo-1-(2,4,6-trichlorophenyl)-1H-pyrazol-3-yl) amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a reversal format, the materials of the invent ion may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl) amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis (1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl) phenoxy-)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl) amino)-3-hydroxyphenyl)-; a mid cyan containing "Coupler 7": Butanamide, N-(4-((2-(2,4-bis(1,1-dimethylpropyl) phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl) amino)-3-hydroxyphenyl)-; and a slow cyan layer containing Couplers 6, 7, and 8;

(10) one or more interlayers possibly including fine-grained nonsensitized silver halide; and

(11) an antihalation layer.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

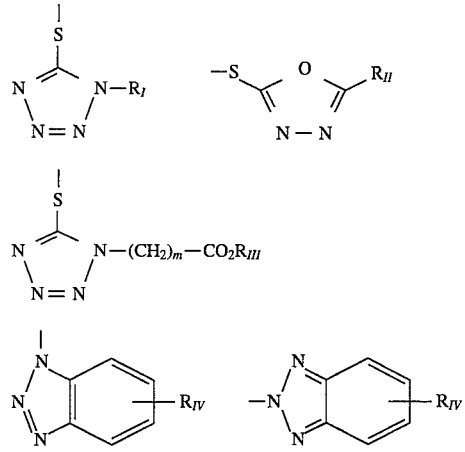

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

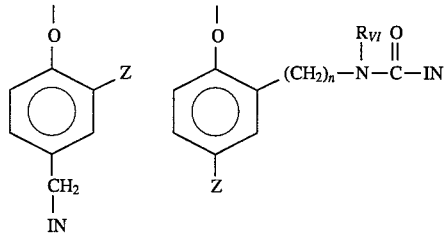

wherein IN is the inhibitor moiety, Z is selected from the group consisting of nitro, cyano, alkylsulfonyl; sulfamoyl ($—SO_2NR_2$); and sulfonamido ($—NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

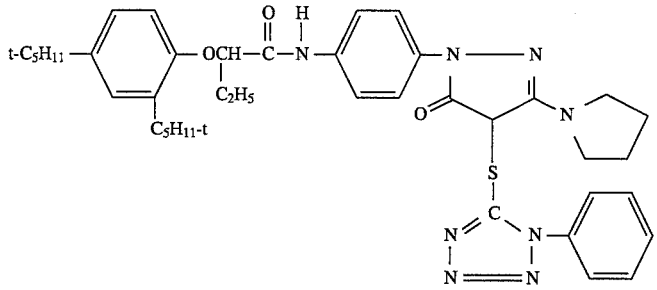

D2

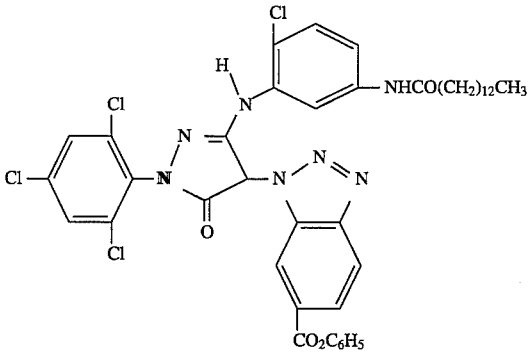

D3

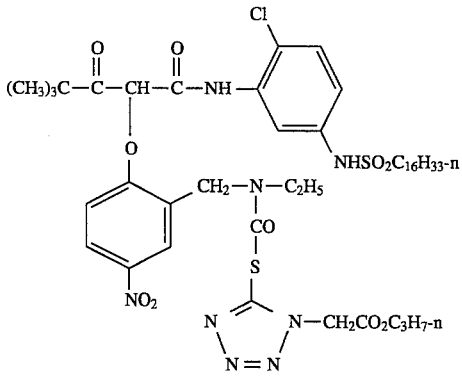

D4

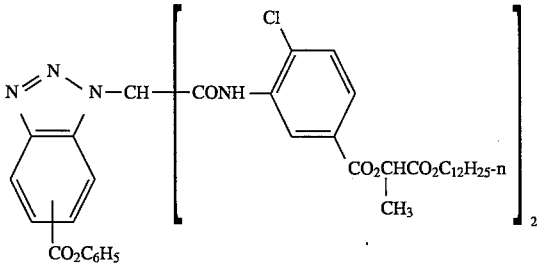

D5

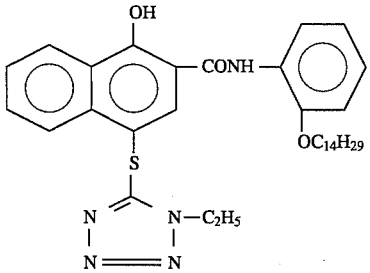

D6

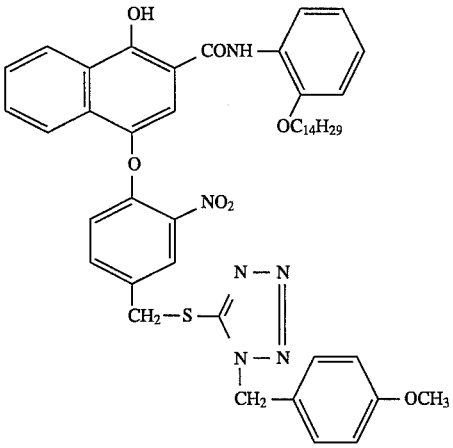

D7

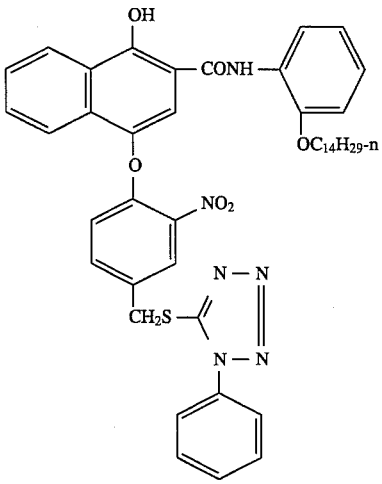

-continued

D8

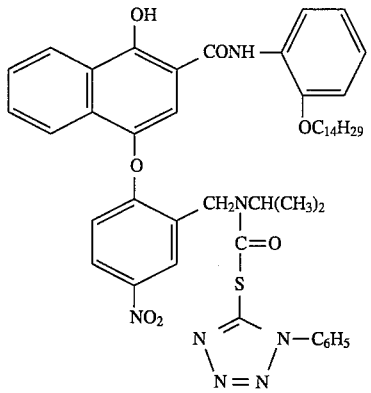

D9

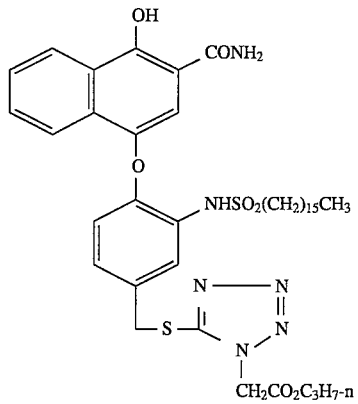

D10

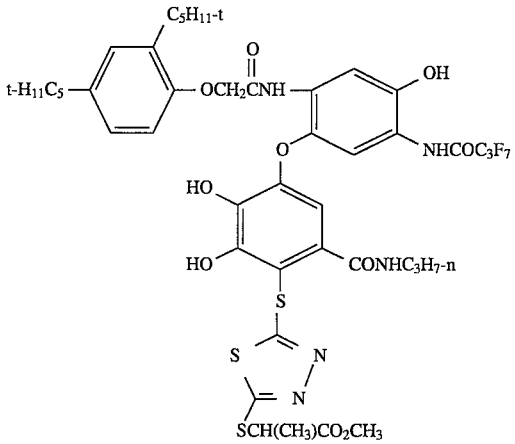

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various patents and other publications cited in this specification are incorporated herein by reference.

EXAMPLE 1

Preparation of Dispersion A:

4.0 g of a n-octadecyl-3-(3'-5'-di-t-butyl-4'-hydroxyphenyl) propionate as Irganox-1706®(CibaGeigy Co.) was dissolved in 400.0 g of diethylphthalate at 50° C., then combined with an aqueous solution consisting of 400.0 g gelatin. 300.0 g of a 10% solution of a mixture of the isomers of the sodium salt isopropylnaphthalene sulfonic acid as Alkanol-XC® (DuPont de Nemours & Co.), 7.2 g of a 0.7% solution of a biocide blend of 5-chloro-2-methyl-4-isothiazolin-3-one and 2-methyl-4-isothiazolin-3-one as Kathon LX® (Rohm and Haas Co.), and 3488.8 g of distilled water, also at 50° C.

This mixture was then premixed using a Silverson mixer for 5 minutes at 5000 rpm and then passed through a Crepaco homogenizer one time at 5000 psi to form a dispersion consisting of 8.0% liquid, 8.0% gel.

Preparation of Dispersions B through O

Dispersions B through O were prepared like Dispersion A except that 400.0 g diethyl phthalate was replaced with 400.0 g of another high-boiling organic liquid as outlined in Table I below.

TABLE I

| Dispersion | Type | High-Boiling Liquid | Log P |
|---|---|---|---|
| A | Comp | Diethylphthalate | 2.57 |
| B | Comp | Dicyclohexylphthalate | 6.80 |
| C | Comp | Bis(2-ethylhexyl)phthalate | 8.92 |
| D | Comp | Didecylphthalate | 11.04 |
| E | Comp | Didodecylphthalate | 13.16 |
| F | Inv | Trihexyl phosphate | 6.70 |
| G | Inv | Oleyl alcohol | 7.69 |
| H | Inv | Acetyl-tri-butyl citrate | 4.78 |
| I | Inv | Phenyl ethyl benzoate | 4.21 |
| J | Inv | Dibutyl sebacate | 5.98 |
| K | Comp | N-n-Butylacetanilide | 2.29 |
| L | Comp | 1,4-Cyclohexylenedimethylene bis(2-ethylhexanoate) | 8.14 |
| M | Comp | Tri(2-ethylhexyl)phosphate | 9.49 |
| N | Inv | Dibutylphthalate | 4.69 |
| O | Inv | Tricresylphosphate | 6.58 |

These dispersions were added to the coating solution used for the antihalation layer to provide a dry coating weight of 0.484 g/m$^2$.

To a corona-discharge-treated polyethylene-2,6-naphthalene support, which was coated with a continuous subbing layer consisting of a terpolymer of n-butyl acrylate, 2-aminoethyl methacrylate hydrochloride, and 2-hydroxyethyl methacrylate (50:05:45) at 0.317 g/m$^2$; deionized gelatin at 0.056 g/m$^2$; matte beads at 0.001 g/m$^2$; and surfactant 10G® (Dixie) at 0.012 g/m$^2$; the following layers were applied in the indicated sequence to produce Coating 1-1. The quantities quoted each relate to g/m$^2$. Emulsion sizes as determined by the disc centrifuge method are reported in Diameter×Thickness in microns.

Layer 1: black colloidal silver at 0.151; gelatin at 1.614; sulfuric acid at 0.0014; Triton X-200® (Rohm and Haas) at 0.040; hexasodium salt of metaphosphoric acid at 0.011; disodium salt of 3,5-disulfocatechol at 0.270; Dye 1 at 0.118; Dye 2 at 0.024; Dye 3 at 0.005; AF-1 at 0.0009; AF-2 at 0.0012.

Layer 2 (Slow cyan layer): a blend of two silver iodobromide emulsions sensitized with Dye Set 1: (i) a small tabular emulsion (1.1×0.09, 4.1 mole % I) at 0.414 and (ii) a very small tabular grain emulsion (0.5 ×0.08, 1.3 mole % I) at 0.506; gelatin at 1.69; cyan dye-forming coupler C-1 at 0.513; bleach accelerator releasing coupler B-1 at 0.037; masking coupler MC-1 at 0.026.

Layer 3 (Mid cyan layer): a red-sensitized (same as above) silver iodobromide emulsion (1.3×0.12, 4.1 mole I) at 0.699; gelatin at 1.79; C-1 at 0.180; DIR-1 at 0.010; MC-1 at 0.022.

Layer 4 (Fast cyan layer): a red-sensitized (same as above) tabular silver iodobromide emulsion (2.9×0.13, 4.1 mole % I) at 1.076; C-1 at 0.104; DIR-1 at 0.019; DIR-2 at 0.048; MC-1 at 0.032; gelatin at 1.42.

Layer 5 (Interlayer): gelatin at 1.29.

Layer 6 (Slow magenta layer): a blend of two silver iodobromide emulsions sensitized with Dye Set 2: (i) 1.0×0.09, 4.1 mole % iodide at 0.280 and (ii) 0.5×0.08, 1.3 % I at 0.542; magenta dye-forming coupler M-1 at 0.255; masking coupler MC-2 at 0.059; gelatin at 1.58.

Layer 7 (Mid magenta layer): a green sensitized (as above) silver iodobromide emulsion: 1.3×0.12, 4.1 mole % iodide at 0.968, M-1 at 0.054; MC-2 at 0.064; DIR-3 at 0.024; gelatin at 1.26.

Layer 8 (Fast magenta layer): a green sensitized (as above) tabular silver iodobromide (2.3×0.13, 4.1 mole I)

emulsion at 0.968; gelatin at 1.116; Coupler M-1 at 0.043; MC-2 at 0.054; DIR-4 at 0.011 and DIR-5 at 0.011.

Layer 9 (Yellow filter layer): AD-1 at 0.108 and gelatin at 1.29.

Layer 10 (Slow yellow layer): a blend of three tabular silver iodobromide emulsions sensitized with sensitizing dye YD-A: (i) 0.5×0.08, 1.3 mole I at 0.193, (ii) 1.0×0.25, 6 mole % I at 0.32 and (iii) 0.81×0.087, 4.5 mole % I at 0.193; gelatin at 2.51; yellow dye-forming couplers Y-1 at 0.750 and Y-2 at 0.289; DIR-6 at 0.064; C-1 at 0.027 and B-1 at 0.003.

Layer 11 (Fast yellow layer): a blend of two blue sensitized (as above) silver iodobromide emulsions: (i) a large tabular emulsion, 3.3×0.14, 4.1 mole % at 0.227 and (ii) a 3-D emulsion, 1.1×0.4, 9 mole % I at 0.656; Y-1 at 0.206; Y-2 at 0.080; DIR-6 at 0.047; C-1 at 0.029; B-1 at 0.005 and gelatin at 1.57.

Layer 12 (UV filter layer): gelatin at 0.699; silver bromide Lippman emulsion at 0.215; UV-1 at 0.108 and UV-2 at 0.108.

Layer 13 (Protective overcoat): gelatin at 0.882; colloidal silica at 0.108.

Hardner (bis(vinylsulfonyl)methane hardener at 1.75% of total gelatin weight), antifoggants (including 4-hydroxy-6-methyl-1,3,3a,7-tetraazaindene), surfactants, coating aids, emulsion addenda, sequestrants, lubricants, matte and tinting dyes were added to the appropriate layers as is common in the art.

Dye 1:

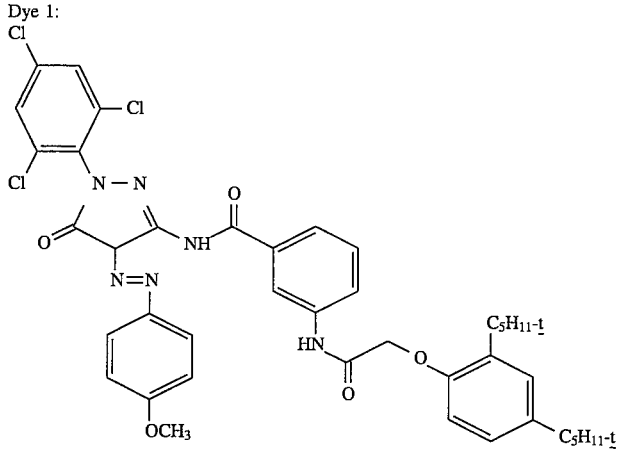

Dye 2:

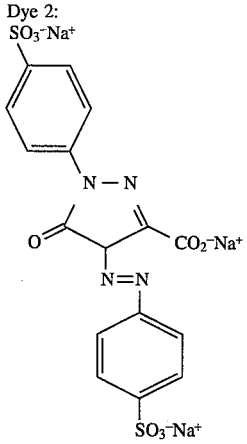

Dye 3:

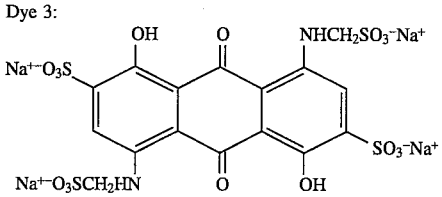

AF-1:

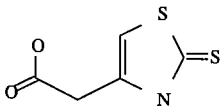

-continued
AF-2:
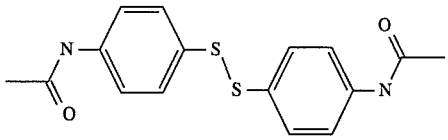
DIR-1:
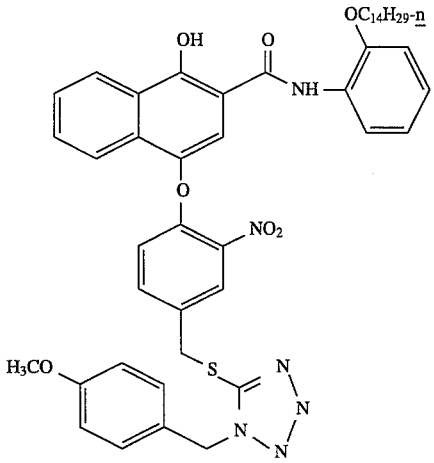
DIR-2:
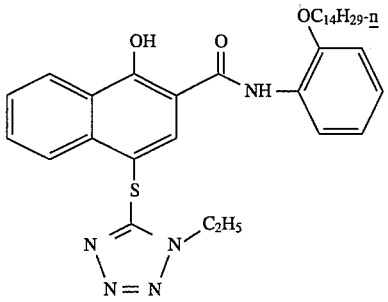
DIR-3:
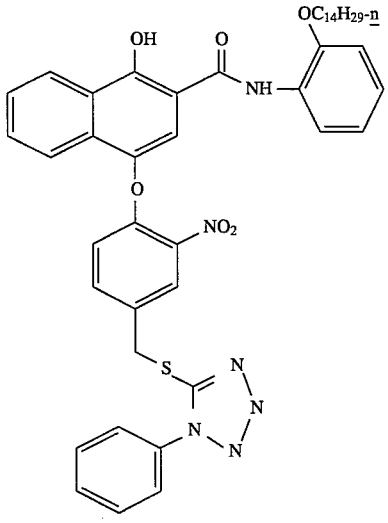

-continued
DIR-4:
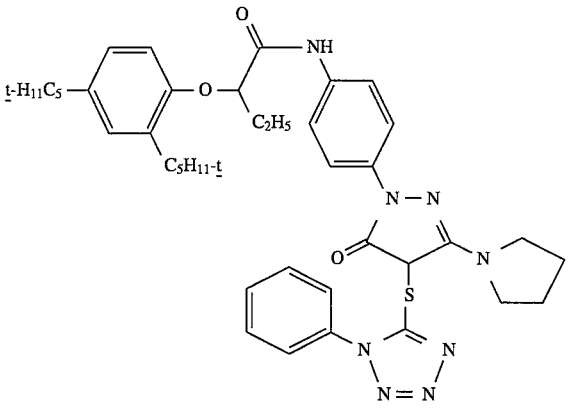
DIR-5:
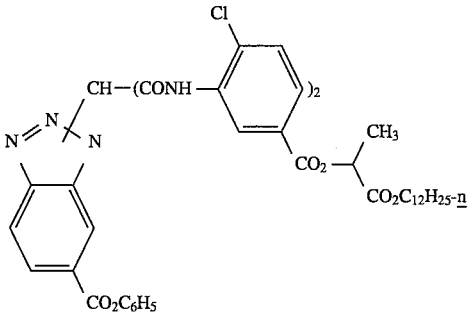
DIR-6:
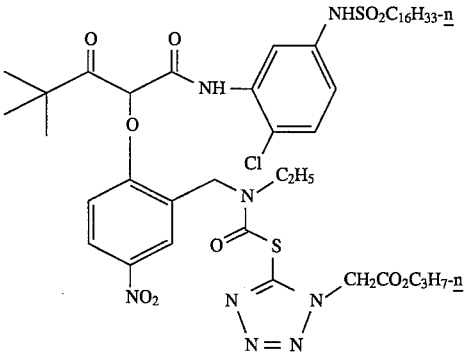
C-1:
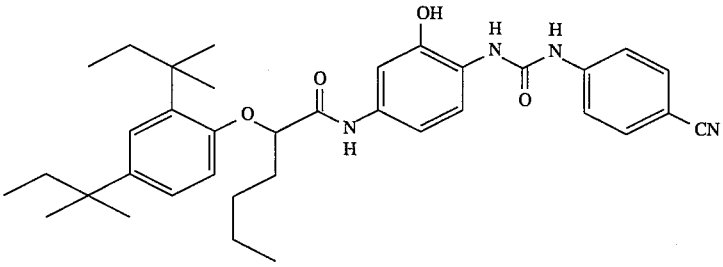

-continued
M-1:
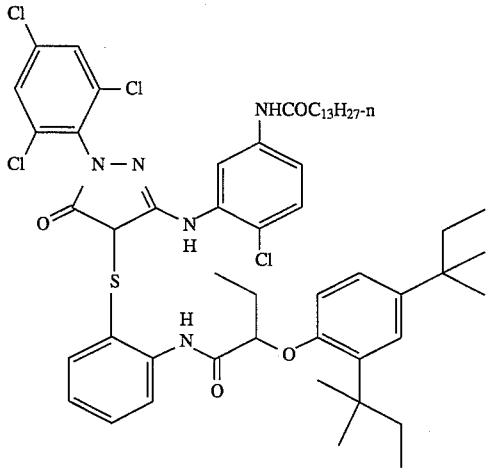
Y-1:
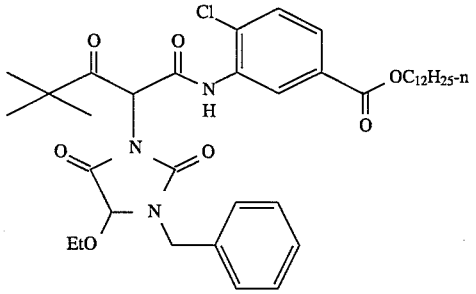
Y-2:
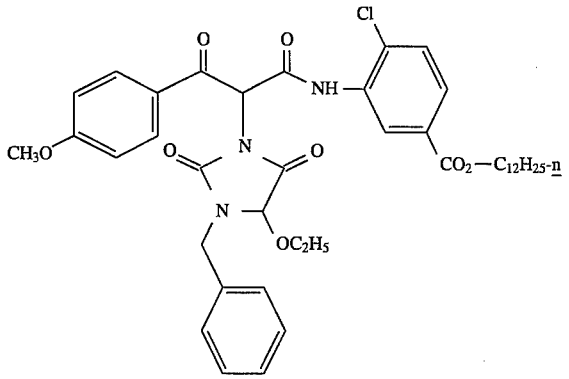
B-1:
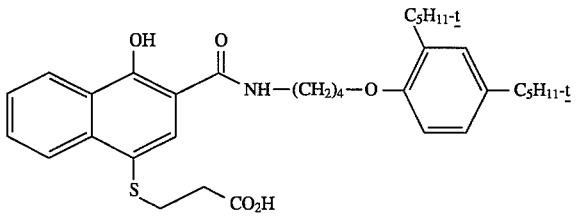

-continued
MC-1:
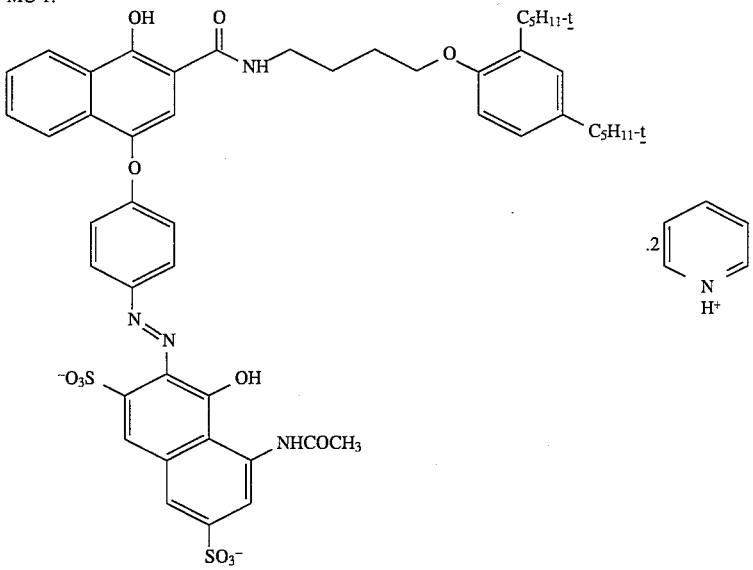
MC-2:
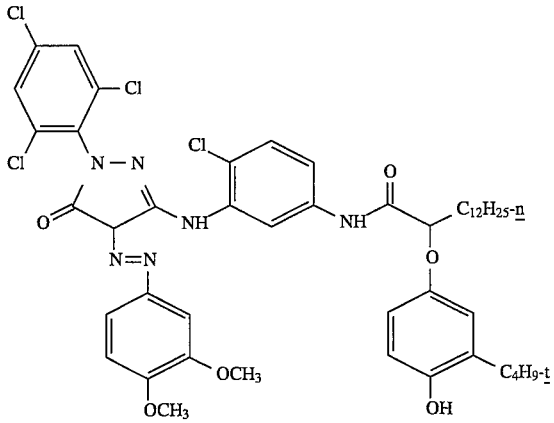
AD-1:
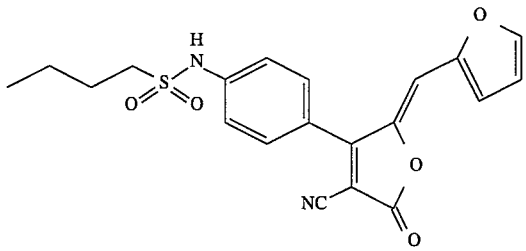
UV-1:
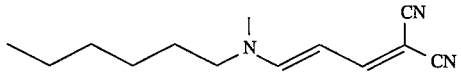
UV-2:
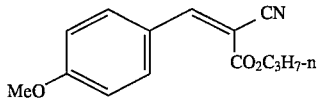
Dye Set 1: CD-A:CD-B at 9:1
Dye Set 2: MD-A:MD-B at 6:1

-continued

CD-A:

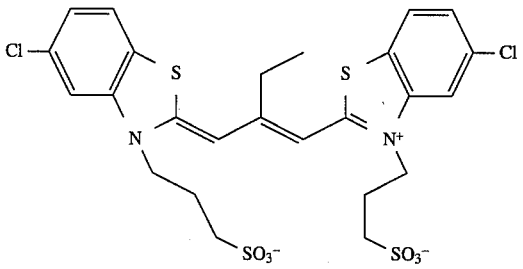

CD-B:

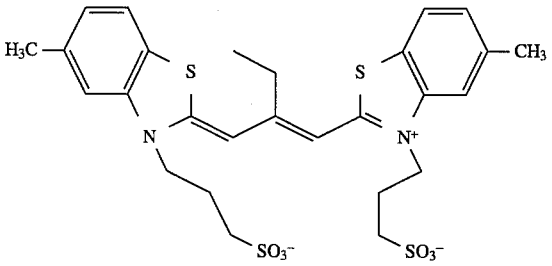

MD-A:

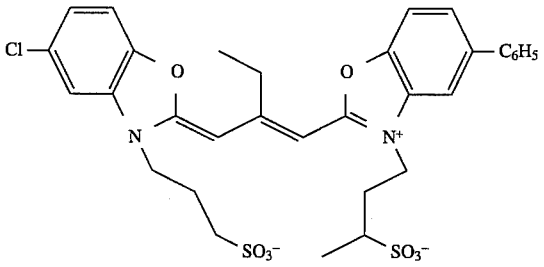

MD-B:

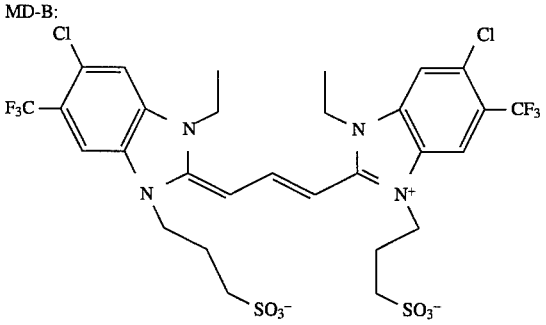

YD-A:

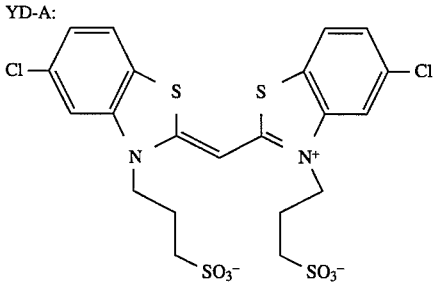

Coatings 1-2 through 1-16 were prepared as Coating 1-1 except that the high-boiling organic liquids shown in Table I were incorporated as dispersions in place of the diethyl phthalate at a coated level of 0.484 g/m$^2$ in each coating as summarized in Table II. Coating 1-17 was a repeat of Coating 1-1, containing no high-boiling organic liquid.

Wet Adhesion Test

A coated photographic film to be tested was immersed in C-41 color developer solution for 3 minutes and 15 seconds at 38° C. The film was then scribed and placed in the apparatus with C-41 developer covering the sample. The apparatus includes an arm with a rubber pad approximately 3.5 cm in diameter attached to the end. A 900 gram weight is applied and the pad is mechanically rubbed perpendicular to the scribed line for 100 cycles at a speed of 60 cycles per minute. The area percent of emulsion removed, if any, was measured using a grid. The test may also be performed on a film sample which has been incubated for 24 hours at 32° C.

TABLE II

| Coating # | Type | Dispersion | % Removed (Fresh) | % Removed (24 hr/32° C.) |
|---|---|---|---|---|
| 1-1 | Comp | no liquid | 19 | 17 |
| 1-2 | Comp | A | 8 | 5 |
| 1-3 | Comp | B | 9 | 9 |
| 1-4 | Comp | C | 9 | 5 |
| 1-5 | Comp | D | 6 | 7 |
| 1-6 | Comp | E | 5 | 4 |
| 1-7 | Inv | F | 4 | 2 |
| 1-8 | Inv | G | 0 | 0 |
| 1-9 | Inv | H | 1 | 1 |
| 1-10 | Inv | I | 0 | 0 |
| 1-11 | Inv | J | 2 | 1 |
| 1-12 | Comp | K | 6 | 2 |
| 1-13 | Comp | L | 7 | 3 |
| 1-14 | Comp | M | 9 | 4 |
| 1-15 | Inv | N | 0 | 0 |
| 1-16 | Inv | O | 3 | 5 |
| 1-17 | Comp | no liquid | 5 | 7 |
| Avg-1 | Comp | No liquid | 12 | 12 |
| Avg-2 | Comp | Check liquid | 7 | 5 |
| Avg-3 | Inv | Inv liquid | 1 | 1 |

These data clearly show that improved wet adhesion was obtained only when the organic liquids of the present invention were employed in the layer adjacent to the subbing layer. The average emulsion removed was less than 10% of the values for the samples using no high-boiling organic liquid and a low 15 to of the values for the samples using the comparative organic liquids. The desired results were obtained only when either oleyl alcohol or an ester of an organic or inorganic acid having a Log P of from 2.6 to 6.7 was employed. Dispersion A using diethyl phthalate having a Log P of 2.57 was not effective. This is believed to be due to migration of the organic liquid from the layer. A particularly advantageous result was obtained with dibutylphthalate (coating 1-15), which exhibited excellent wet adhesion promoting properties, while all of the other phthalate esters tested provided markedly inferior wet adhesion.

EXAMPLE 2

Coating 2-1 was prepared like Coating 1-1 of Example 1. Coatings 2-2 through 2-20 were also prepared similarly, except for the high boiling organic liquid dispersion types and levels coated, as outlined below in Table III.

TABLE III

| Coating # | Type | Organic Liquid Coated (g/m$^2$) |
|---|---|---|
| 2-1 | Comp | no organic liquid |
| 2-2 | Inv | dispersion O (0.484) |
| 2-3 | Inv | dispersion M (0.161) + dispersion O (0.323) |
| 2-4 | Inv | dispersion M (0.242) + dispersion O (0.242) |
| 2-5 | Inv | dispersion M (0.323) + dispersion O (0.161) |
| 2-6 | Comp | dispersion M (0.484) |
| 2-7 | Comp | dispersion M (0.242) |
| 2-8 | Comp | dispersion M (0.430) |
| 2-9 | Comp | dispersion M (0.538) |
| 2-11 | Inv | dispersion O (0.484) |
| 2-12 | Inv | dispersion O (0.323) + dispersion N (0.161) |
| 2-13 | Inv | dispersion O (0.242) + dispersion N (0.242) |
| 2-14 | Inv | dispersion O (0.161) + dispersion N (0.323) |
| 2-15 | Inv | dispersion N (0.484) |
| 2-17 | Inv | dispersion N (0.430) |

TABLE III-continued

| Coating # | Type | Organic Liquid Coated (g/m$^2$) |
|---|---|---|
| 2-18 | Inv | dispersion N (0.538) |
| 2-19 | Inv | dispersion N (0.726) |
| 2-20 | Comp | no organic liquid |

These coatings were then subjected to the wet adhesion test described in the previous example and the following results were obtained.

TABLE IV

| Coating # | Type | Dispersion (Wt % Inv Liquid) | % Removed (Fresh) |
|---|---|---|---|
| 2-1 | Comp | No liquid | 16 |
| 2-2 | Inv | O (100%) | 2 |
| 2-3 | Inv | M/O (67%) | 1 |
| 2-4 | Inv | M/O (50%) | |
| 2-5 | Inv | M/O (33%) | 2 |
| 2-6 | Comp | M (0%) | 4 |
| 2-7 | Comp | M (0%) | 4 |
| 2-8 | Comp | M (0%) | 4 |
| 2-9 | Comp | M (0%) | 4 |
| 2-11 | Inv | O (100%) | 2 |
| 2-12 | Inv | O/N 2:1 (100%) | 1 |
| 2-13 | Inv | O/N 1:1 (100%) | 0 |
| 2-14 | Inv | O/N 1:2 (100%) | 0 |
| 2-15 | Inv | N (100%) | 0 |
| 2-17 | Inv | N (100%) | 0 |
| 2-18 | Inv | N (100%) | 0 |
| 2-19 | Inv | N (100%) | 0 |
| 2-20 | Comp | No liquid | 9 |
| Avg-1 | Comp | No liquid | 13 |
| Avg-2 | Comp | Check liquid | 4 |
| Avg-3 | Inv | Inv liquid | <1 |

The results clearly show that wet adhesion was substantially improved when dispersions of the organic liquids of the invention are present in the layer adjacent the subbing layer. The presence of the inventive liquid reduces the average amount removed to less than 10% of that for the corresponding samples with no high boiling organic liquid and to less than of that with the check organic liquids. It appears that when the layer contains both liquids within and outside the invention, the inventive liquid should comprise at least 25 wt.% of the total high-boiling organic liquid in that layer. In particular, the dispersion N containing dibutylphthalate provides superior results.

EXAMPLE 3

Dispersions of the following high-boiling organic liquids were prepared as described in Example 1:

TABLE V

| Dispersion | Type | High-Boiling Liquid |
|---|---|---|
| P | Comp | Hexadecyl alcohol |
| Q | Comp | Undecyl alcohol |
| R | Inv | Oleyl alcohol |
| S | Inv | Oleyl alcohol |
| T | Inv | Dibutylphthalate |

Coating 3-1 was prepared like Coating 1-1 of Example 1. Coatings 3-2 through 3-6 were also rpepared similarly, except for the liquid dispersion types and levels coated, as outlined below in Table VI. The coatings were then subjected to the wet adhesion test described in Example 1 and the following results were obtained.

TABLE VI

| Coating # | Type | Dispersion | % Removed (Fresh) | % Removed (24 hr/32° C.) |
|---|---|---|---|---|
| 3-1 | Comp | no liquid | 1 | 3 |
| 3-2 | Comp | P | 1 | 2 |
| 3-3 | Comp | Q | 92 | 100 |
| 3-4 | Inv | R | 0 | 0 |
| 3-5 | Inv | S | 0 | 0 |
| 3-6 | Inv | T | 0 | 0 |

These data clearly demonstrate that excellent wet adhesion was obtained with the dispersed organic liquids of the present invention. The results also indicate that oleyl alcohol has unique wet adhesion promoting properties compared with other high-boiling alcoholic liquids.

What is claimed is:

1. A photographic element comprising a polyester support bearing a light-sensitive silver halide photographic emulsion layer, the support having adjacent thereto a polymer-containing subbing layer, the subbing layer having adjacent thereto a layer comprising a hydrophilic binder containing dispersed droplets of a selected high boiling organic liquid, said liquid being selected from the group consisting of oleyl alcohol and esters of organic or inorganic acids which have a value for the logarithm of their octanol/water partition coefficient (Log P) of from 2.6 to 6.7 wherein the wt. ratio of hydrophilic binder to total organic liquid in the hydrophilic binder layer is at least 3 to 1.

2. The photographic element of claim 1 wherein said esters of organic or inorganic acids are selected from the group consisting of di-n-butyl phthalate, phenylethyl benzoate, acetyl-tri-butyl citrate, dibutyl sebacate, trihexylphosphate, and tricresylphosphate.

3. The photographic element of claim 2 wherein said ester of an organic or inorganic acid is di-n-butyl phthalate.

4. The photographic element of claim 1 wherein said selected high boiling organic liquid is oleyl alcohol.

5. The photographic element of claim 1 wherein the layer containing the selected high boiling organic liquid additionally contains another high boiling liquid wherein the selected high boiling liquid constitutes at least 25 wt. % of the total high boiling organic liquid coated in said layer.

6. The photographic element of claim 1 wherein the polyester support comprises at least one polymer derived from a monomer selected from the group consisting of terephthalic acid, isophthalic acid, phthalic acid, 2,5-, 2-6-, and 2,7-naphthalene dicarboxylic acids, succinic acid, sebacic acid, adipic acid, azelaic acid, diphenyl dicarboxylic acid, hexahydroterephthalic acid, and bis-p-carboxy phenoxy ethane.

7. The photographic element of claim 1 wherein said polyester support is polyethylene terephthalate.

8. The photographic element of claim 1 wherein the surface of the support adjacent to the subbing layer is a treated surface.

9. The photographic element of claim 8 in which the surface adjacent to the subbing layer is a glow discharge treated surface.

10. The photographic element of claim 8 in which the surface of the support adjacent to the subbing layer is a corona discharge treated surface.

11. The photographic element of claim 8 in which the surface of the support adjacent to the subbing layer is a chemically treated surface.

12. The photographic element of claim 1 wherein the hydrophilic binder contains gelatin.

13. The photographic element of claim 1 wherein the layer containing the hydrophilic binder and dispersed organic liquid also contains an antihalation component.

14. The photographic element of claim 13 wherein the antihalation component is elemental silver.

15. The photographic element of claim 1 wherein the subbing layer includes at least one polymer formed from a monomer having polar groups in the molecule selected from the group consisting of carboxyl, carbonyl, hydroxy, sulfo, amino, amido, epoxy, and acid anhydride groups.

16. The photographic element of claim 1 wherein the subbing layer includes a polymer containing one of the monomers selected from the group consisting of acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, and glycidyl methacrylate.

17. The photographic element of claim 1 wherein the subbing layer includes at least one polymer containing a monomer selected from the group consisting of vinylidene chloride, acrylonitrile, acrylate, and methacrylate.

18. The photographic element of claim 17 wherein said polymer is selected from the group consisting of butyl acrylate, 2-aminoethyl methacrylate hydrochloride, and hydroxyethyl methacrylate.

19. The photographic element of claim 1 wherein the subbing layer contains from 25 to 85 wt % polymer.

20. The photographic element of claim 1 wherein the organic liquid is an ester having a Log P of from 4.2 to 6.7.

21. A process for forming an image after image-wise exposing the photographic element of claim 1 to light, comprising contacting the element with a developing agent.

22. The process of claim 21 wherein the developing agent is a color developing agent.

23. A process for preparing a photographic element comprising a polyester support bearing a light-sensitive silver halide photographic emulsion layer, comprising:

applying a continuous subbing layer containing a polymer on a surface of the support;

applying to the subbing layer a layer comprising a hydrophilic binder containing dispersed droplets of a selected high boiling organic liquid, said liquid being selected form the group consisting of oleyl alcohol and esters of organic or inorganic acids which have a value for the logarithm of their octanol/water partition coefficient (Log P) of from 2.6 to 6.7, wherein the wt. ratio of hydrophilic binder to total organic liquid in the hydrophilic binder layer is at least 3 to 1; and thereafter applying over said layer comprising a hydrophilic binder a layer containing a photographic silver halide emulsion layer.

24. The process of claim 23 wherein the surface of the support is subjected to a treatment prior to applying the continuous subbing layer.

25. The process of claim 24 wherein the treatment is selected from the group consisting of a chemical treatment, a mechanical treatment, a corona discharge, a glow discharge, a flame treatment, a UV irradiation, a radio frequency treatment, electron bombardment, an active plasma treatment, electrodeless discharge, a laser treatment, a mixed acid treatment, and ozone-oxidation treatment.

26. The process of claim 25 wherein the treatment is a glow discharge treatment.

27. A photographic element comprising a polyester support bearing a light-sensitive silver halide photographic emulsion layer, the support having adjacent thereto a polymer-containing subbing layer, the subbing layer having adjacent thereto a layer comprising a hydrophilic binder containing dispersed droplets of a selected high boiling organic liquid, said liquid being selected from the group consisting of oleyl alcohol and esters of organic or inorganic acids which have a value for the logarithm of their octanol/water partition coefficient (Log P) of from 2.6 to 6.7 wherein said selected high boiling organic liquid is oleyl alcohol.

28. A photographic element comprising a polyester support bearing a light-sensitive silver halide photographic emulsion layer, the support having adjacent thereto a polymer-containing subbing layer, the subbing layer having adjacent thereto a layer comprising a hydrophilic binder containing dispersed droplets of a selected high boiling organic liquid, said liquid being selected from the group consisting of oleyl alcohol and esters of organic or inorganic acids which have a value for the logarithm of their octanol/water partition coefficient (Log P) of from 2.6 to 6.7 wherein the layer containing the selected high boiling organic liquid additionally contains elemental silver.

29. The photographic element of claim 28 wherein the wt. ratio of hydrophilic binder to organic liquid in the hydrophilic binder layer is at least 3 to 1.

30. The element of claims 1, 2, 3, 5, 8, 12, 15, 17, 19, 27, and 28 in which said polyester support is polyethylene-2,6-naphthalate.

* * * * *